US005754922A

United States Patent [19]

Bessho

[11] Patent Number: 5,754,922

[45] Date of Patent: May 19, 1998

[54] AUTOMATIC EXPOSURE ADJUSTING METHOD AND APPARATUS

[75] Inventor: Ichiro Bessho, Aichi-ken, Japan

[73] Assignee: Minolta Co., Ltd., Osaka, Japan

[21] Appl. No.: 711,070

[22] Filed: Sep. 9, 1996

Related U.S. Application Data

[63] Continuation of Ser. No. 412,925, Mar. 29, 1995, abandoned.

[30] Foreign Application Priority Data

Mar. 30, 1994 [JP] Japan ..... 6-061353

[51] Int. Cl.[6] ..... G03G 15/04

[52] U.S. Cl. ..... 399/52; 355/69; 355/77

[58] Field of Search ..... 355/214, 228, 355/208, 68, 69, 77; 399/52

[56] References Cited

U.S. PATENT DOCUMENTS 4,879,576 11/1989 Naito ..... 355/214

FOREIGN PATENT DOCUMENTS 62-169182 7/1987 Japan .
3-249778 11/1991 Japan .
3-296036 12/1991 Japan .
4-263270 9/1992 Japan .
5-150622 6/1993 Japan .

*Primary Examiner*—Arthur T. Grimley
*Assistant Examiner*—Sophia S. Chen
*Attorney, Agent, or Firm*—Burns, Doane, Swecker & Mathis, LLP

[57] ABSTRACT

This invention concerns an automatic exposure adjusting apparatus which permits infallible production of a signal corresponding exactly to the density of a given original document constantly even when the components of an optical system thereof cause any dispersion or gradual deterioration due to aging. First, the apparatus exposes a standard white subject copy 1 set on a document table 2 to the light of a preset standard amount of exposure, samples the reflected light from the copy 1 by a light detector 14, and adjusts to a proper magnitude the output value of an original document density signal emitted from a noninverting amplifier 33. Then, it exposes the standard density plate 3 to the light of an adjusted standard amount of exposure, samples the reflected light from the standard density plate 3 by the light detector 14, and readjusts to a proper magnitude the output value of an original document density signal issued from the noninverting amplifier 33. By this procedure, the apparatus is enabled to produce infallibly an original document of a proper density constantly.

16 Claims, 6 Drawing Sheets

AUTOMATIC EXPOSURE ADJUSTING METHOD AND APPARATUS

This application is a continuation of application No. 08/412,925, filed Mar. 29, 1995, which became abandoned on Sep. 9, 1996.

BACKGROUND OF THE INVENTION

This invention relates to an automatic exposure adjusting apparatus for automatically adjusting the amount of exposure so as to ensure constant, infallible production of a signal corresponding exactly to the density of a given original document even when the components of an optical system thereof cause any dispersion or gradual deterioration due to aging.

In the image processing apparatus such as a copying device or a facsimile which produces an image of a given original document by optically scanning the surface of the original document, the produced image fails to reflect faithfully the density of the original document or gets obscured with smear when the exposure lamp for illuminating the original document, the photodiode for receiving the reflected light from the surface of the original document and detecting the density of the original document, or the like causes a dispersion or a variation due to aging.

For the purpose of eliminating this drawback, the invention disclosed in JP-A-03-249,778 and the invention disclosed in JP-A-03-296,036, for example, have been proposed.

The invention of JP-A-03-249,778 pertains to an image processing apparatus operating on the basis of a procedure which comprises sampling by means of a photodiode the reflected light from a standard white subject copy set by an operator on a document table for supporting an original document and adjusting the gain which arises when the output current of this photodiode is subjected to voltage conversion so that the subject copy density signal (voltage) obtained from the photodiode (using an electric current for output) may conform to a prescribed value (set in advance as by RAM). This adjustment of the gain permits automatic adjustment of the exposure lamp, the photodiode, or the like with respect to the dispersion or the variation due to aging and consequently ensures emission of a signal exactly conforming to the density of the original document.

The invention of JP-A-03-296,036 pertains to an image processing apparatus operating on the basis of a procedure which comprises, when the luminous energy of an exposure lamp has been altered, causing the reflected light from a standard density plate disposed near a document table for supporting an original document to be sampled by use of photoelectric transfer means and adjusting the gain which arises when the output current from the photoelectric transfer means is subjected to voltage conversion so that the original density signal (voltage) obtained from the photoelectric transfer means may conform to a prescribed value (set in advance as by RAM). This adjustment of the gain permits production of the optimum copy density and removes the bad influence of the background part of the surface of the original document.

These conventional image processing apparatuses, however, still have the following problems because they are required to sample the reflected light from the standard white subject copy set on the document table or the standard density plate disposed near the document table by the use of a photodiode or a photoelectric transfer means and finally adjust the gain so as to obtain a desired original document density signal.

First, when the distance between the standard density plate and the photoelectric transfer means or the density level of the standard density plate is varied from one to another of the copiers being assembled in a quantity production line, it follows that the amount of light from the standard density plate received by the photoelectric transfer means inevitably varies from one to another of the copiers. As a natural consequence, the gain of voltage obtained from the photoelectric transfer means is dispersed among the produced copiers. When the distance between the standard density plate and the photoelectric transfer means is extremely small and the density level is high, for example, the copied image is inevitably smeared with fog because the gain is set at a large magnitude.

For the purpose of eliminating this problem, it ought to suffice to set the density level of the standard density plate with high accuracy incapable of dispersion and, at the same time, set the distance between the standard density plate and the photoelectric transfer means with high accuracy. This approach, however, is at a disadvantage in increasing the number of steps in the process of assemblage and consequently degrading the efficiency of operation.

Such problems as are pointed out above do not confront the conventional image processing apparatus which is adapted to have the standard white subject copy set on the document table and effect the adjustment of the gain which occurs when the output current from the photodiode is subjected to voltage conversion. This image processing apparatus, however, is required to effect control for the stabilization of an image with an AIDC (auto image density control) and a $V_O$ sensor and set the standard white subject copy on the document table and adjust the gain of the photodiode whenever the amount of exposure is changed. Thus, it has the problem that this adjustment calls for troublesome work. The AIDC is a device for forming a latent image on a standard patch placed on a photosensitive element as with an exposure lamp, adhering a toner on the latent image thereby forming a toner image, projecting the light of a sensor on the toner image, causing the reflected light to be received as by a photosensor thereby effecting detection of the image density of the standard patch, and controlling the luminous energy or the like of the exposure lamp to be projected on the standard patch so as to adjust the image density to a desired level. This detection of the image density by the AIDC may be made to occur either during the course of prescanning or at the same time that the density of the original document is detected by regular scanning.

Then, the image processing apparatus of the type which implements the adjustment of the gain by means of the standard density plate has the problem that the proper adjustment of the gain will not be constantly obtained because the standard density plate is burned by the heat radiated by the exposure lamp or because the density level of the standard density plate is gradually altered by the deposition of dirt. When the density level of the standard density plate is eventually elevated in consequence of deterioration by aging, for example, the hardship may be coped with by, in accordance with a consequent alteration in the setting of the exposure lamp, sampling the reflected light from the standard density plate by the use of photoelectric transfer means and adjusting the gain so as to ensure production of the same density data as were attained at the time of assemblage of the apparatus. Since this gain is inevitably set at a large magnitude, the copied images subsequently obtained are fated to be smeared with fog. Conceivably, this trouble may be prevented by properly correcting the density data during the adjustment of the gain in accordance with the gradual change of the density level of the standard density plate. Since the condition of the gradual change of the density level of the standard density plate naturally differs with the environment in which a particular copier is used, however, one same correction cannot be given to all the copiers. After all, the replacement of the standard density plate with a new supply is the only measure.

SUMMARY OF THE INVENTION

An object of this invention is to provide an automatic exposure adjusting method and apparatus which allows infallible constant production of a signal corresponding exactly to the density of a given original document even when the components of an optical system thereof cause any dispersion or gradual deterioration due to aging.

The method according to this invention comprises a first adjusting step and a second adjusting step. The first adjusting step includes three steps. First, a sensor is used to receive the reflected light produced when light of a standard amount of exposure of an exposure lamp is emitted on a standard white subject member and convert a reflected light reflected from said member into an electric signal according to the amount thereof. Secondly, a gain of a light detection circuit is adjusted so that, when the light detection circuit receives the electric signal and outputs a output signal as a first original document density signal, the output signal coincides with a predetermined density signal. Thirdly, this step is performed by receiving in a sensor the reflected light produced when a standard density member disposed near a document table is exposed to the light of the standard amount of exposure, converting the reflected light into an electric signal according to the amount of the reflected light, inputting the electric signal into the light detection circuit, and amplifying the inputted electric signal with the adjusted gain thereby producing a second original document density signal. In the second adjusting step, the gain of the light detection circuit is readjusted so that, when the reflected light produced by the exposure of the standard density member to the light of the amount of exposure varied in consequence of the variation of the standard amount of exposure is received by the sensor, converted into an electric signal according to the amount of the reflected light, and outputted as a third original document density signal through the light detection circuit, the third original document density signal coincides with the second original document density signal.

In the apparatus according to this invention, a sensor receives the reflected light produced by the exposure of a standard white subject copy member to a light of a preset standard amount of exposure from said exposure lamp and emits an electric signal according to the amount of said reflected light. A light detection circuit receives said electric signal from said sensor, converts said electric signal, and outputs a output signal as an original document density signal of said standard white subject member. A first controller adjusts a gain of said light detection circuit so that said first original document density signal outputted from said light detection circuit coincides with a predetermined density signal. A standard density member is disposed near a document table. A second controller receives into said sensor the reflected light resulting from the exposure of said standard density member to the light of said standard amount of exposure, amplifies with said gain the electric signal converted in accordance with the amount of said reflected light, and emits the amplified electric signal as a second original document density signal from said light detection circuit. A third controller receives into said sensor the reflected light produced by the exposure of said standard density member to the amount of exposure varied in consequence of the variation in said standard amount of exposure and readjusts the gain so that, when said electric signal converted in accordance with the amount of reflected light is outputted as a third original document density signal from said light detection circuit, said third original document density signal coincides with said second original document density signal.

BRIEF DESCRIPTION OF THE DRAWINGS

This invention will be better understood and the objects, features, and advantages thereof other than those set forth above will become apparent when consideration is given to the following detailed description thereof, which makes reference to the annexed drawings wherein.

DETAILED DESCRIPTION OF THE INVENTION

Figure 1:
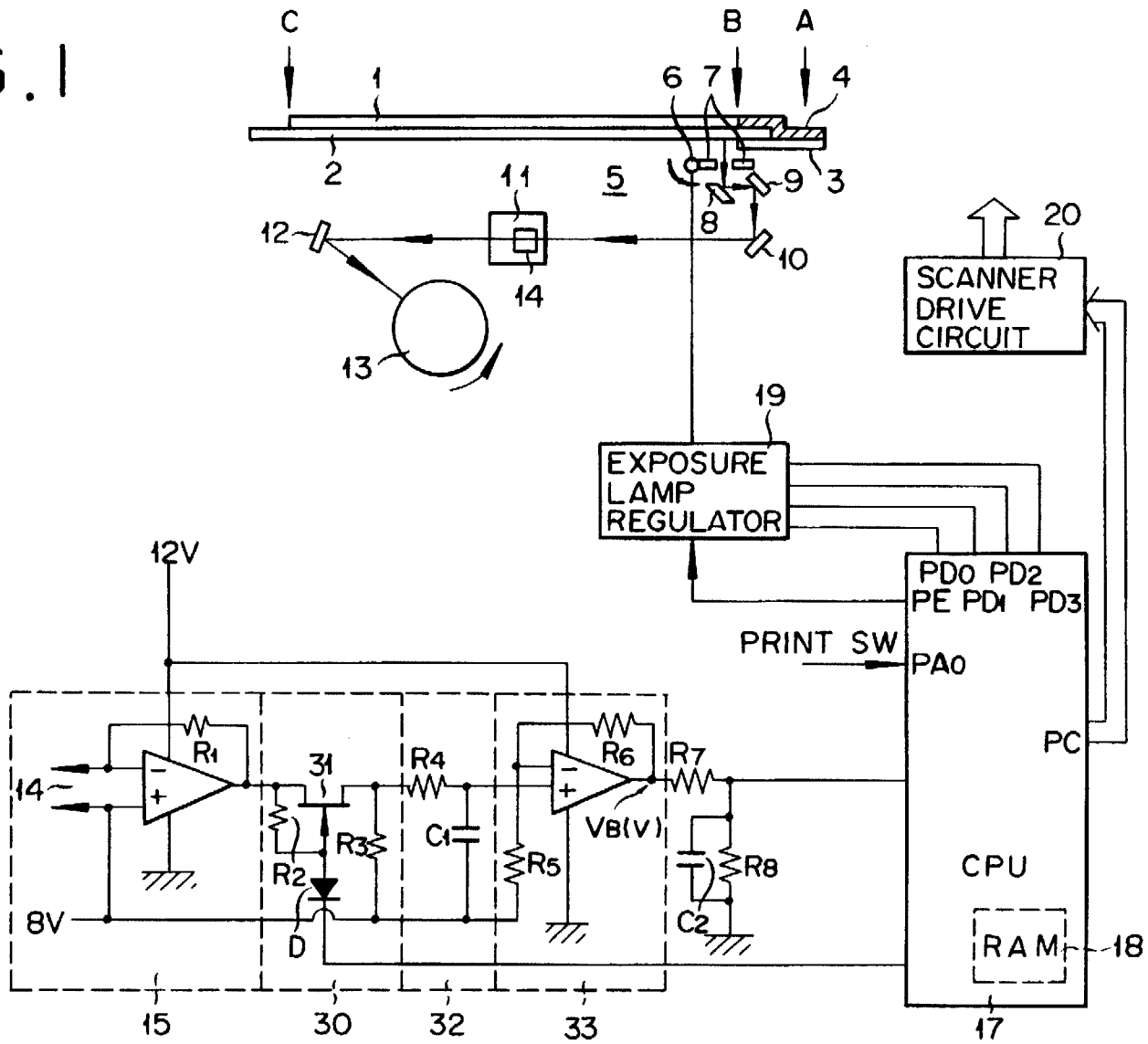
FIG. 1 is a diagram schematically illustrating the construction of an automatic exposure adjusting apparatus according to this invention.

Now, embodiments of this invention will be described in detail below with reference to the accompanying drawings. FIG. 1 schematically illustrates the construction of an automatic exposure adjusting apparatus according to this invention. As shown in the diagram, an original document 1 to be copied is set on a transparent document table 2 for setting an original document. A standard density plate 3 is pasted on the rear surface of an original document scale 4 which concurrently serves as fixing means for the document table 2. Below the document table 2, a scanning optical system (hereinafter referred to as "scanner") 5 scans the original document 1 and the standard density plate 3 in the form of ribbons. This scanner comprises an exposure lamp 6 for projecting a beam of light, an optical slit 7 for passing the reflected light through a reduced area, reflecting mirrors 8, 9, and 10, a focusing lens 11, a reflecting mirror 12, and an unshown mechanical part driven in fixed relationships with the components mentioned above. The scanner 5 begins the scanning motion from the position A and continues it via the position B to the position C. While the scanner 5 is producing the scanning motion, the exposure lamp 6, the first mirror 8, and the optical slit 7 move toward the left direction in the diagram while passing the standard density plate 3 and the original document 1 sequentially in the order mentioned and, in the meantime, the second mirror 9 and the third mirror 10 move toward the left direction in the diagram at one half of the speed of the motion of the first mirror 8 and the optical slit 7 so that the length of the light path for the formation of an image may remain constant. A photosensitive drum 13 is rotated in the direction of an arrow indicated in the diagram as synchronized with the motion of the scanner 5, with the result that a charged latent image conforming to the image of the original document 1 will be formed on the photosensitive drum 13.

In the projected light path incident on the photosensitive drum 13, a light detector 14 for detecting the intensities, i.e. the densities, of the reflected lights from the standard density plate 3 and the original document 1 is disposed. This light detector 14 is composed of such a light receiving element as a photodiode, for example, and is adapted to generate an electric current in accordance with the amount of light admitted through the optical slit 7. To this light detector 14 is connected a circuit which comprises a current-voltage conversion circuit 15, a circuit 30 for driving a field effect transistor (FET) 31, an integration circuit 32, and a voltage amplifier circuit 33 which will be specifically mentioned hereinbelow. These circuits 15, 30, 32, and 33 are included in the light detector 14. The light detector 14 and the various circuits 15, 30, 32, and 33 jointly form a light detection circuit.

The current signal which is emitted in accordance with the density from the light detector 14 is converted by the current-voltage conversion circuit 15 into an analog voltage signal. This analog voltage signal is chopped by the field effect transistor (FET) 31 in accordance with the gain adjusting signal (PWM) ON/OFF duty ratio from a CPU 17 and then thoroughly eliminated of the ON/OFF ripple by the integration circuit 32 and converted into a DC voltage. The gain (damping factor) of the analog signal resulting from the current-voltage conversion, therefore, is determined by the duty ratio of the pulse width modulation (PWM) signal. Thereafter, the DC voltage is amplified by a noninverting amplifier 33 and inputted into the CPU 17.

Let $I_D$ stand for the photoelectric current flowing to a diode D, T for the cycle of the gain adjusting signal, and $t_H$ for the duration of the existence of "HIGH", and the original document density signal $V_M$ will be represented by the following formula, wherein $V_B$ denotes the potential at the output terminal of the operational amplifier shown in FIG. 1.

Since $V_M(V)=V_B\times R_8/(R_7+R_8)$ and further since $V_B=8-I_D\times R_1\times(t_H/T)\times(1+R_6/R_5)$, the following formula is satisfied.

$$V_M=\{8-I_D\times R_1\times(t_H/T)\times(1+R_6/R_5)\}\times R_8/(R_7+R_8)$$

It is clearly noted from this formula that the gain of the light detection circuit mentioned above is determined, depending on the duty ratio of $(t_H/T)$.

The circuit constructed as illustrated in FIG. 1 has no use for a D/A converter and, therefore, is enabled to attain required variation of the gain by the use of only one signal line from the CPU 17 in the place of eight signal lines otherwise required for the data bus and, consequently, accomplish a saving of cost. It also has the advantage that it offers high resistance to noise because it utilizes a signal of a modulated pulse width as the gain adjusting signal.

Figure 2:
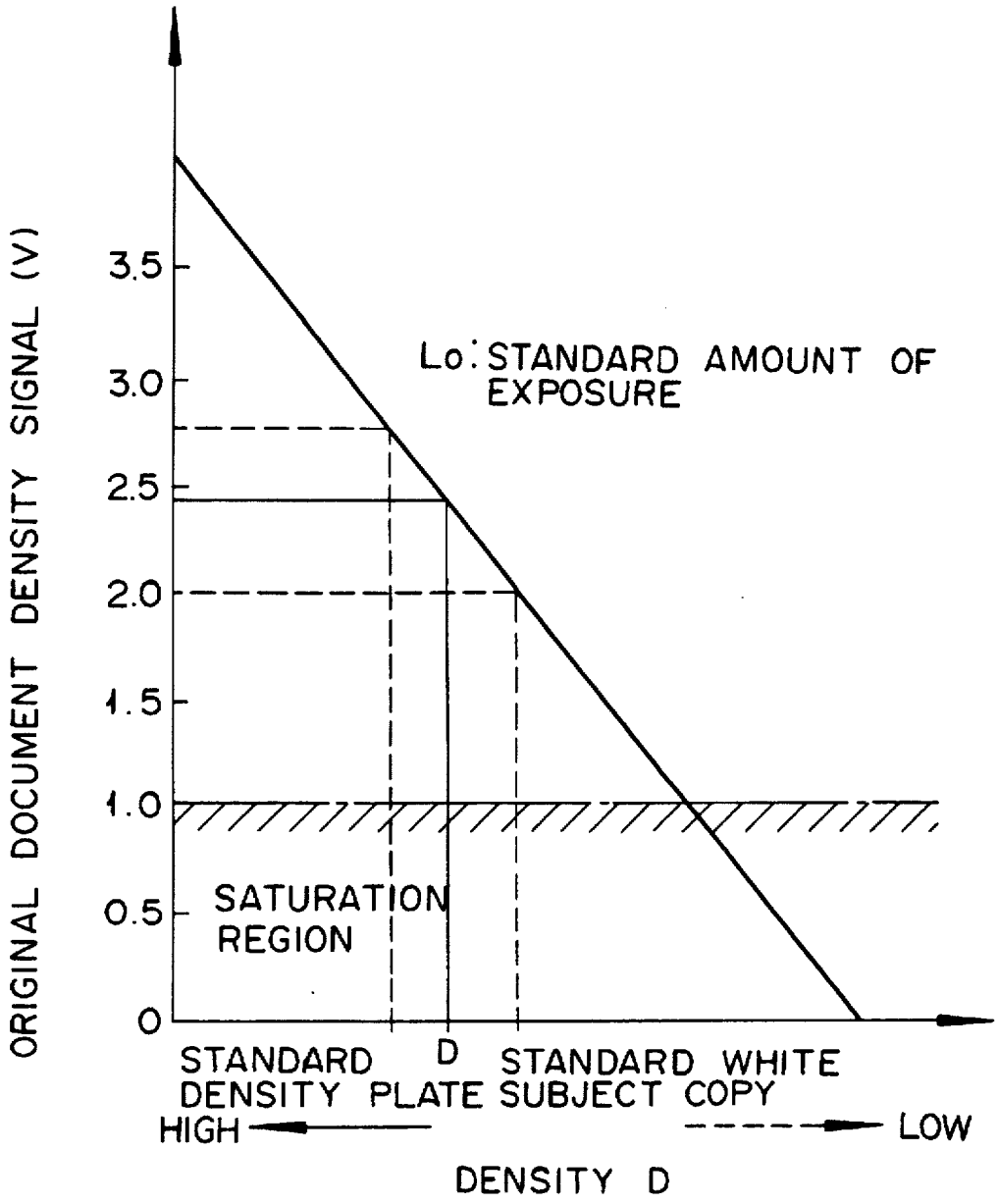
FIG. 2 is a diagram showing the relation between the density of an original document and the original document density signal with respect to the standard amount of exposure $L_O$.

The characteristics of the light detection circuit which is constructed as described above are as illustrated in FIG. 2. FIG. 2 shows the relation between the density D of the standard density plate 3, a standard white subject copy, or the original document and the magnitude of the voltage which is emitted in the form of an original document density signal from the light detection circuit when the respective sources of density mentioned above are exposed to the standard amount of exposure $L_O$. This standard amount of exposure $L_O$ is the amount of exposure of the exposure lamp which is set in advance during the mechanical design of the apparatus so that the image density of the standard patch obtained by the AIDC may permit satisfactory reproduction of an image to be copied. Incidentally, this standard amount of exposure $L_O$ is varied by the fact that the image density of the standard patch obtained by the AIDC is lowered by gradual deterioration of the photosensitive drum. Besides, the standard amount of exposure $L_O$ is affected by the gradual deterioration, optical defilement, or the like of the exposure lamp itself. When the standard density plate 3 of such density as is shown in FIG. 2 is exposed to the standard amount of exposure $L_O$, for example, the light detection circuit emits a voltage of about 2.75 V as an original document density signal. By the same token, when the standard white subject copy of the density shown in the diagram is exposed thereto, a voltage of about 2.0 V is emitted. When the original document of the density D is exposed thereto, a voltage of about 2.45 V is emitted as an original document density signal. This light detection circuit must be operated in regions other than the saturation region.

Figure 3:
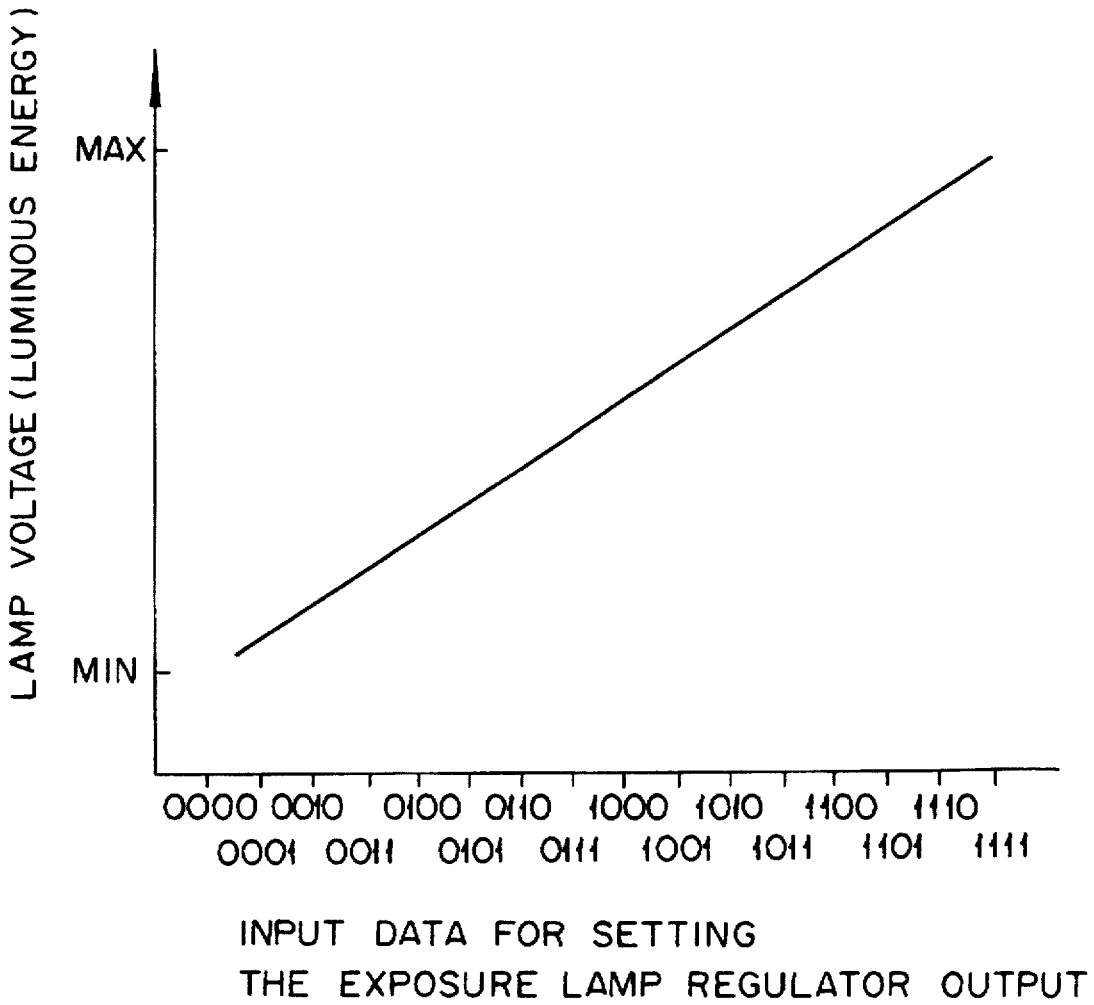
FIG. 3 is a diagram showing the relation between the input data for setting the exposure lamp regulator output and the lamp voltage (luminous energy).
Figure 4:
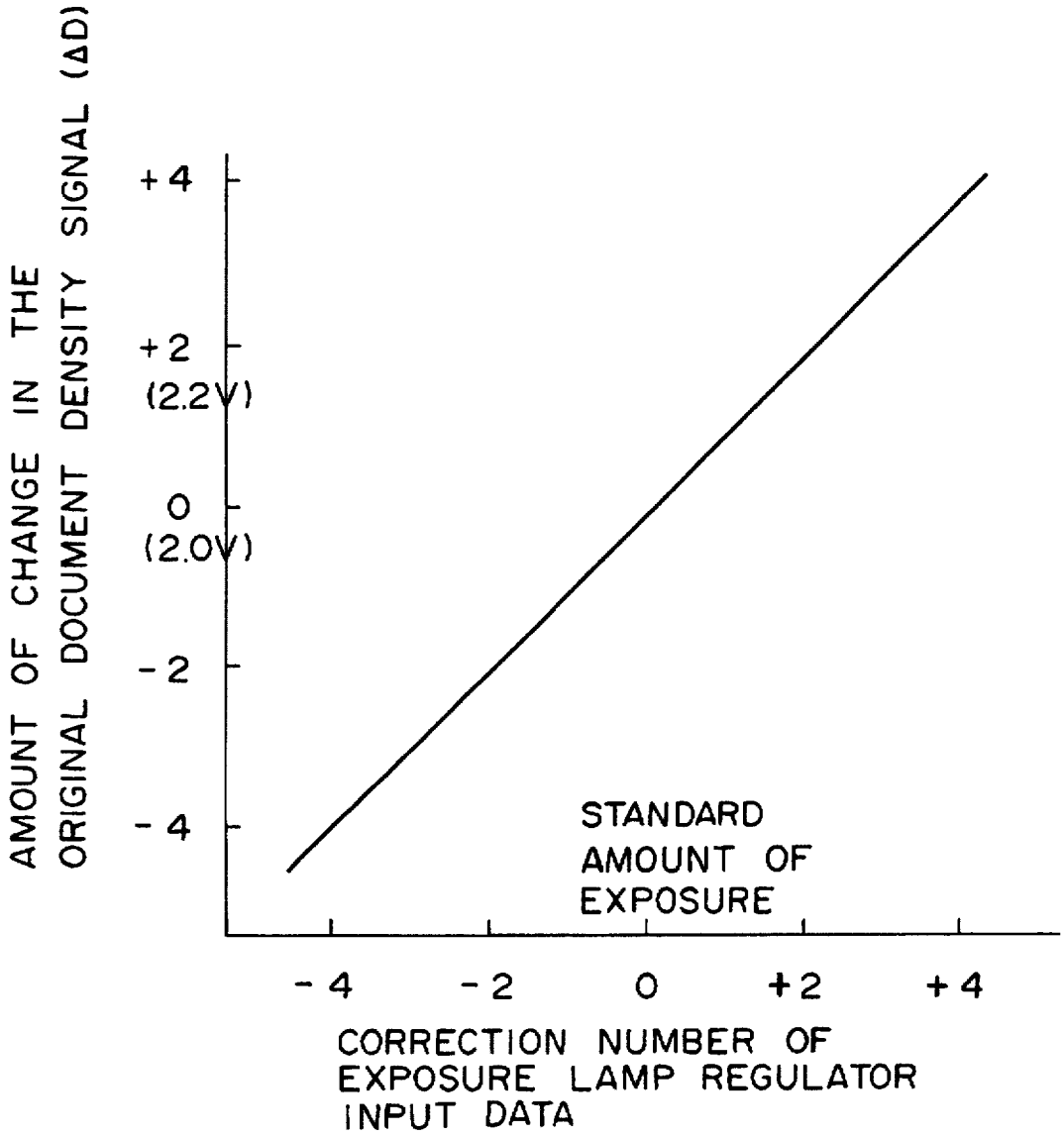
FIG. 4 is a diagram showing the relation between the correction number of exposure lamp regulator input data and the amount of change in the original document density signal.

An exposure lamp regulator 19 has the ON/OFF switching thereof controlled by the signal from an output port PE of the CPU 17. When this exposure lamp regulator 19 is turned ON, it feeds a voltage to the exposure lamp 6 and turns the lamp 6 on. The voltage emitted from the exposure lamp regulator 19 is controlled by 4-bit digital data issued from output ports $PD_0$ through $PD_3$ of the CPU 17. FIG. 3 shows typical characteristics of the digital data, namely the input data for setting the exposure lamp regulator output, and the voltage to be fed to the exposure lamp 6, namely the luminous energy of the exposure lamp 6 for illumination. As shown in the diagram, the luminous energy of the exposure lamp 6 linearly increases with the increase of the input data for setting the exposure lamp regulator output. The digital data are varied on the basis of the density data which are inputted through the input port during the scanning of the original document 1. The mode of this variation is set in advance so as to describe a linear relation as shown in FIG. 4 in this case. Specifically, the amount of variation ΔD of the original document density signal emitted from the light detection circuit and the amount of variation (correction number) of the input data to the exposure lamp regulator 19 are so related as to satisfy a ratio of 1:1.

When the original document density signal is set at 2.0 V by the adjustment of gain which will be specifically mentioned hereinbelow at the time that the standard white subject copy is illuminated with the standard amount of exposure $L_O$ mentioned above and the density data of the original document indicate 2.2 V, for example, a magnitude of 0.2 V is obtained by the difference of the latter from the former magnitude to indicate the difference of "+2" relative to the standard white subject copy, namely the density of "+2" higher than that of the standard white subject copy. To equalize the amount of reflected light with that of the standard white subject copy, therefore, the luminous energy of the exposure lamp 6 must be increased. This increase can be realized by correcting the input data of the exposure lamp regulator 19 with "+2" according to the characteristics of FIG. 4 and operating the exposure lamp 6 with the luminous energy which is the sum of the standard amount of exposure to be specifically mentioned hereinbelow and the amount of exposure corresponding to the correction number "+2" of the exposure lamp regulator input data.

With reference to FIG. 1, when an unshown print key for starting a copying operation is pushed, the switch signal emitted consequently is inputted into an input port $PA_0$ of the CPU 17 and utilized, through the medium of the output port PE, to turn ON the exposure lamp regulator 19 and turn on the exposure lamp 6 and, at the same time, actuate a scanner drive circuit 20 in response to the scanner control signal issued from an output port PC. In consequence of this actuation, the scanner 5 begins its scanning motion at the position A. This automatic exposure control may be effected by either the sequential correction method or the preliminary scanning method. The sequential correction method consists in implementing the copying of an original document while scanning the original document to detect the density thereof and, at the same time, correcting the amount of exposure sequentially in accordance with the detected density so as to regulate the amount of the reflected light from the original document constantly at a fixed level. The preliminary scanning method resides in preliminarily scanning an original document to detect the density thereof and, during the regular scanning for the copying operation, controlling the amount of exposure to a proper level for the original document.

Now, the operation of the automatic exposure adjusting apparatus of this invention for the adjustment of gain will be described below. Preparatorily to the description of the detail of operation, the operation of the apparatus of this invention will be briefed.

In the apparatus of this invention, when the light of the standard amount of exposure from the exposure lamp 6 is projected on the standard white subject copy set on the document table 2, the light detection circuit samples the reflected light from the subject copy and issues an original document density signal and the gain of the light detection circuit is adjusted so that this original document density signal may conform to a prescribed magnitude stored in advance as a standard original document density signal in the RAM. This makes the first time that the adjustment of gain is made. At this time, the gain so adjusted is stored in a RAM 18. Then, the light of the standard amount of exposure is emitted on the standard density plate 3 disposed near the photosensitive drum 13. The reflected light from the standard density plate 3 is sampled by the light detection circuit and the corresponding output of the light detection circuit is stored as a new original document density signal by the gain stored in the RAM 18. Then, in consequence of the variation in the luminous energy of the exposure lamp 6 mentioned above, the reflected light from the standard density plate 3 is sampled by the light detection circuit and the gain of the light detection circuit is again adjusted so that the original document density signal obtained from the light detection circuit may coincide with the original document density signal memorized as mentioned above. The apparatus permits infallible acquisition of ideal copy density constantly by implementing the formation of an image with two rounds of the adjustment of gain.

Now, the adjustment of gain will be described in detail below.

First, the initial adjustment of gain for adjusting the gain of the light detection circuit is carried out on the basis of the standard white subject copy. Incidentally, this initial adjustment of gain is executed during the assemblage of the apparatus, during the maintenance of the apparatus by a serviceman, or the like.

The scanner 5 first moves to the position of the standard white subject copy which is set on the document table 2 and illuminates the standard white subject copy with the light of the standard amount of exposure $L_0$. At this time, the CPU 17 reads out the original document density signal emitted from the light detection circuit and adjusts the duty ratio of the gain adjusting signal so that the original document density signal may conform to the magnitude 2.0 V stored in advance in the RAM 18. Then, the duty ratio of the gain adjusting signal resulting from the foregoing adjustment is stored in the RAM 18. Thus, the inclination of the solid line shown in FIG. 2 is decided.

Subsequently, the scanner 5 is moved to a position below the standard density plate 3 and made to project the light of the standard amount of exposure $L_0$ on the standard density plate 3. Then, the original document density signal which is obtained with the duty ratio of the gain adjusting signal stored in the RAM 18 is put to storage in the RAM 18. The selection of the magnitude, 2.0 V, for the original document density signal in this case has the purpose of precluding the occurrence of a saturation region due to the use of an operational amplifier or the like in the light detection circuit and, at the same time, repressing the possible erroneous control in the presence of a variation due to noise or drift by setting the ratio of the original document density signal to the original document density difference at a large magnitude, namely the sensitivity at a high level.

Subsequently to the initial adjustment of gain, the gain which is affected by a variation in the standard amount of exposure is readjusted. The processing from this point onward is carried out in accompaniment of the scanning operation or the prescanning operation.

Figure 5:
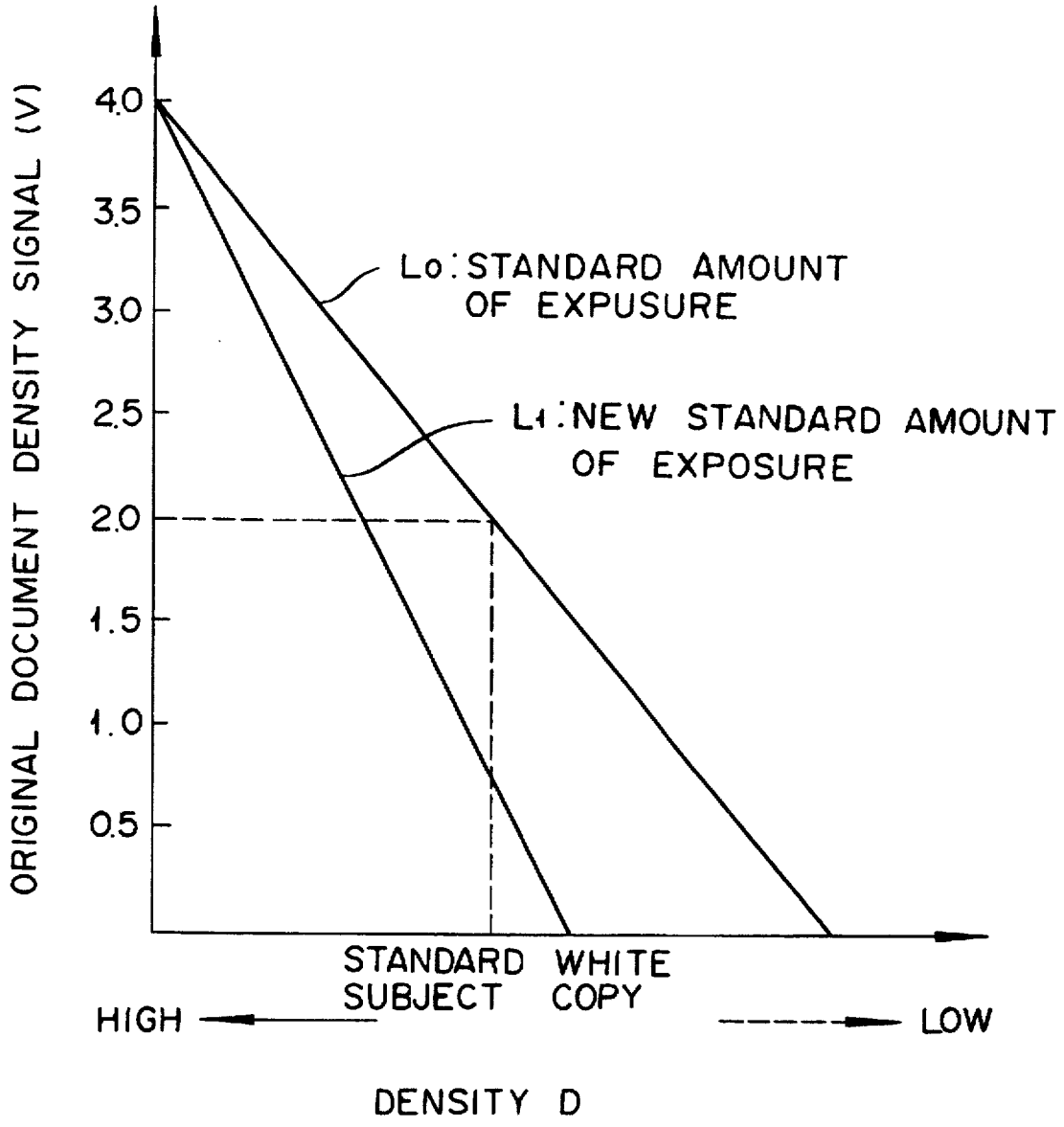
FIG. 5 is an explanatory diagram illustrating the condition of change in the original document density signal due to the transfer of the standard amount of exposure $L_O$ to the standard amount of exposure $L_1$.

As described above, the standard amount of exposure is corrected on the basis of the standard latent image by reason of gradual deterioration, optical defilement, or the like of the photosensitive drum 13 and is varied in consequence of the correction. The magnitude of the original document density signal relative to the original document density is varied as shown in FIG. 5 when the standard amount of exposure $L_0$ is changed to the standard amount of exposure $L_1$ as shown in the diagram. As a result, the correction of the amount of the luminous energy of the exposure lamp relative to an original document of high density will be no longer obtainable. To be specific, for the gain of a fixed magnitude, the original document density signal has a magnitude for low density and the image is smeared with fog when the luminous energy of the exposure lamp 6 increases. The original document density signal of a magnitude for high density is obtained and the image is obscured with voids when the luminous energy decreases. To avoid this trouble, the magnitude of the original document density signal relative to the original document density must be normalized by varying the gain adjusting signal so as to readjust the gain of the light detection circuit.

This normalization is accomplished by illuminating the standard density plate 3 with the corrected standard amount of exposure $L_1$ and correcting the gain adjusting signal so that the magnitude of the original document density signal may coincide with the original document density signal obtained by the standard density plate 3 and stored in the RAM 18 mentioned above.

Figure 6:
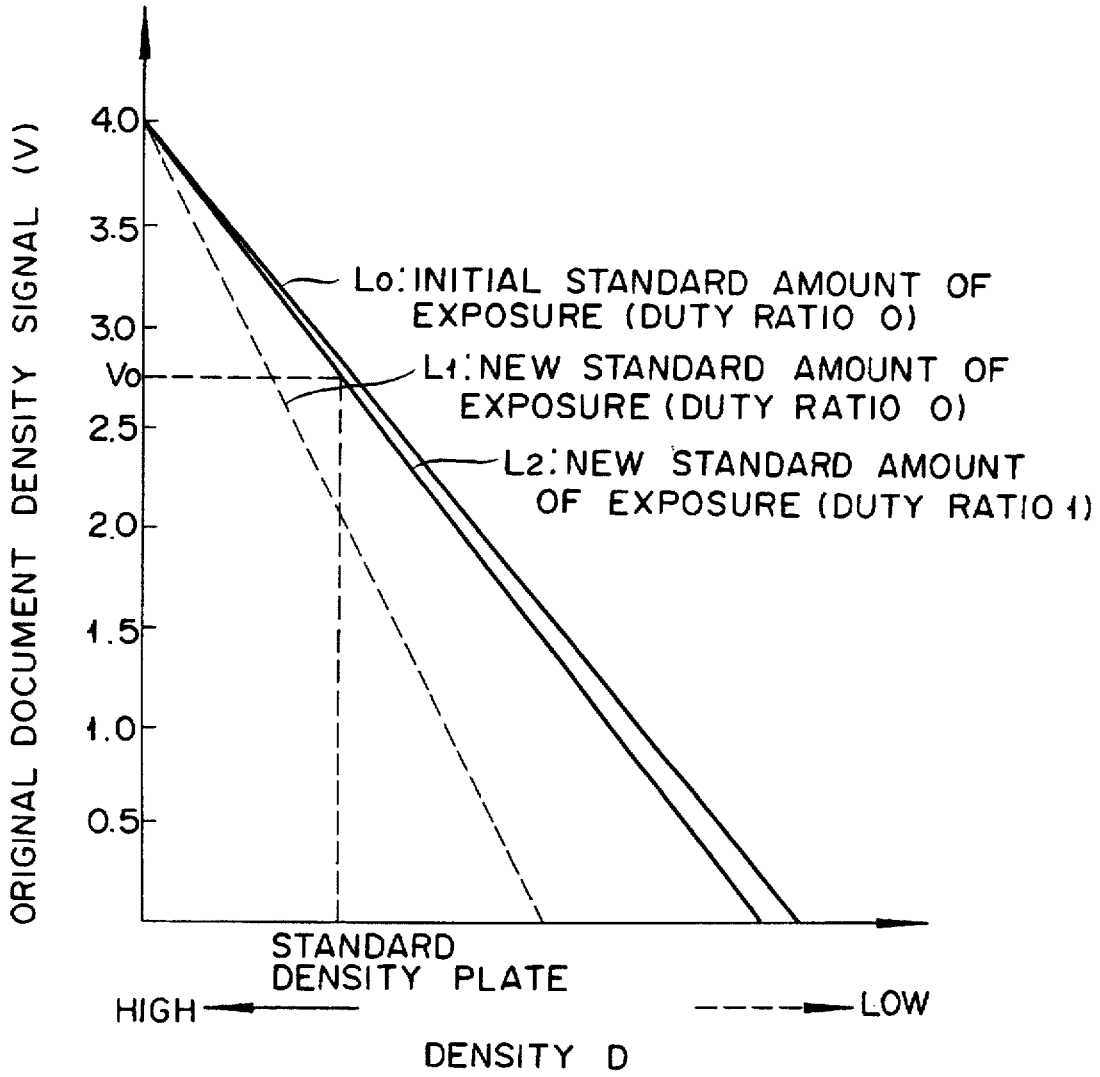
FIG. 6 is an explanatory diagram illustrating the adjustment of gain for the transfer of the standard amount of exposure $L_1$ to the standard amount of exposure $L_2$.

By making this correction, by changing the duty ratio of the gain adjusting signal from 0 to 1 as shown in FIG. 6, the new standard amount of exposure $L_1$ indicated by the dotted line in the diagram can be changed to a new standard amount of exposure $L_2$ which approximates the initial standard amount of exposure $L_0$ and the magnitude of the original document density signal relative to the original document density can be normalized.

Where the density level of the standard density plate 3 and the distance between the standard density plate 3 and the light detector 14 are originally dispersed among the image processing apparatuses or where the density level of the standard density plate 3 is dispersed in consequence of, gradual deterioration among the image processing apparatuses, the deviation may be eliminated during the assemblage of image processing apparatuses or during the maintenance thereof by a serviceman, specifically when an assemblyman or a serviceman effects a key input for the adjustment of gain of the light detection circuit or turns on the print key, by sampling the reflected light from the standard white subject copy set on the document table 2 instead of the standard density plate 3 and adjusting the gain of the light detection circuit, namely the gain adjusting signal (PWM) ON/OFF duty ratio, so that the level of the original document density signal obtained from the light detection circuit may coincide with the level of the original document density signal obtained from the original document. In spite of the dispersion mentioned above, the gain of the light detection circuit can be adjusted on the basis of the original document density signal obtained from an original document having a fixed density level.

In short, this invention implements the memorization of the density level of the standard density plate 3 in each image processing apparatus by sampling the reflected light from the standard density plate 3 by means of the gain of the light detection circuit which is obtained when the reflected light from the standard density plate 3 is sampled. When the luminous level of the exposure lamp 6 is varied, the gain of the light detection circuit is readjusted so that the density level of the standard density plate 3 may coincide with the density level which is obtained when the sampling is repeated. Since this invention effects on each image processing apparatus the memorization of the density level of the standard density plate 3 which is actually attached to the apparatus instead of effecting the memorization of the density level of the standard density plate uniformly in each of the image processing apparatuses as conventional cases has been heretofore practiced, the adjustment of the gain of the light detection circuit can be carried out based on the memorized density level of the standard density plate 3 when the luminous energy of the exposure lamp 6 is varied. Unlike the conventional apparatus, the apparatus of this invention does not need to attach the standard white subject copy to the document table 2 and adjust the gain each time the luminous energy is varied. Thus, the apparatus of this invention lightens the work burden on the part of a user or a serviceman.

Since the variation of the luminous energy can be corrected automatically and properly by the two-stage adjustment of gain described above, the necessity for a serviceman setting the standard white subject copy again and readjusting the gain each time the luminous energy is varied is obviated. Even when the absolute value of the density of the standard density plate is dispersed, the proper correction can be attained in spite of this dispersion. The standard density plate, therefore, tolerates rough management of the density thereof and loose accuracy of the attachment thereof. This fact permits a saving of cost and adds to the efficiency of operation. Even when the standard density plate is accidentally defiled or burned, the correction required consequently can be attained by repeating the initial gain adjustment (the first of the two stages of gain adjustment mentioned above).

Though the embodiment cited above has been depicted as using a photodiode for the light receiving element of the light detector, it is permissible to use a photo transistor, a pin diode, an unbalance diode, or the like instead.

I claim:

1. An exposure adjusting method for adjusting the luminous energy of an exposure lamp in an image forming apparatus capable of illuminating the image of an original document with said exposure lamp and forming said image on a photosensitive element with the reflected light from said original document, which comprises a first adjusting step and a second adjusting step, said first adjusting step including:

a step of using a sensor for receiving the reflected light produced when a light of a standard amount of exposure of said exposure lamp is emitted on a standard white subject member and for converting a reflected light reflected from said member into an electric signal according to the amount thereof;

a step of adjusting a gain of a light detection circuit so that, when said light detection circuit receives said electric signal and outputs a output signal as a first original document density signal, said output signal coincides with a predetermined density signal; and a step of receiving in a sensor the reflected light produced when a standard density member disposed near a document table is exposed to the light of the standard amount of exposure, converting the reflected light into an electric signal according to the amount of said reflected light, inputting said electric signal into said light detection circuit, and amplifying the inputted electric signal with said adjusted gain thereby producing a second original document density signal, and said second adjusting step including:

a step of readjusting the gain of said light detection circuit so that, when the reflected light produced by the exposure of said standard density member to the light of the amount of exposure varied in consequence of the variation of the standard amount of exposure is received by said sensor, converted into an electric signal according to the amount of said reflected light, and outputted as a third original document density signal through said light detection circuit, said third original document density signal coincides with said second original document density signal.

2. A method according to claim 1, wherein said first adjusting step is carried out during the assemblage of the image forming apparatus or during the maintenance thereof.

3. A method according to claim 1, wherein said second adjusting step is carried out after completion of said first adjusting step and synchronously with a scanning operation or a prescanning operation.

4. A method according to claim 1, which further comprises a step of storing the gain adjusted in said first adjusting step.

5. A method according to claim 1, which further comprises a step of storing said second original document density signal obtained in said first adjusting step.

6. A method according to claim 1, wherein the variation of said standard amount of exposure originates in gradual deterioration and/or optical defilement of said exposure lamp and/or photosensitive element.

7. An exposure adjusting apparatus for adjusting the luminous energy of an exposure lamp in an image forming apparatus capable of illuminating the image of an original document with said exposure lamp and forming said image on a photosensitive element with the reflected light from said original document, which comprises:

a sensor which receives the reflected light produced by the exposure of a standard white subject copy member to a light of a preset standard amount of exposure from said exposure lamp and emits an electric signal according to the amount of said reflected light;

a light detection circuit which receives said electric signal from said sensor, converts said electric signal, and outputs a output signal as an original document density signal of said standard white subject member;

a first controller which adjusts a gain of said light detection circuit so that said first original document density signal outputted from said light detection circuit coincides with a predetermined density signal;

a standard density member disposed near a document table;

a second controller which receives into said sensor the reflected light resulting from the exposure of said standard density member to the light of said standard amount of exposure, amplifies with said gain the electric signal converted in accordance with the amount of said reflected light, and emits the amplified electric signal as a second original document density signal from said light detection circuit; and a third controller which receives into said sensor the reflected light produced by the exposure of said standard density member to the amount of exposure varied in consequence of the variation in said standard amount of exposure and readjusts the gain so that, when said electric signal converted in accordance with the amount of reflected light is outputted as a third original document density signal from said light detection circuit, said third original document density signal coincides with said second original document density signal.

8. An apparatus according to claim 7, which further comprises a memory which stores the gain adjusted by said first controller.

9. An apparatus according to claim 7, which further comprises a memory which stores said second original document density signal as standard density data of said standard density plate.

10. An apparatus according to claim 7, wherein said adjustment of gain by said first controller is carried out during the assemblage of the image forming apparatus or during the maintenance thereof.

11. An apparatus according to claim 7, wherein said adjustment of gain by said third controller is carried out after said adjustment of gain by said first controller and synchronously with a scanning operation or a prescanning operation.

12. An apparatus according to claim 7, wherein the variation of said standard amount of exposure originates in gradual deterioration and/or optical defilement of said exposure lamp and/or photosensitive element.

13. An apparatus according to claim 7, wherein said light detection circuit is provided with a light current-voltage conversion circuit for converting into an analog voltage signal the current signal indicating the original document density detected and converted by said sensor in accordance with the amount of exposure.

14. An apparatus according to claim 13, wherein the gain of the analog voltage signal resulting from current-voltage conversion is determined by the gain adjusting signal emitted from a CPU.

15. An apparatus according to claim 14, wherein said gain adjusting signal is a pulse width modulating signal and said gain is determined by varying the duty ratio of said pulse width modulating signal.

16. An apparatus according to claim 15, wherein the luminous energy of said exposure lamp increases when the gain is increased by varying said duty ratio and the luminous energy decreases when the gain is conversely decreased.

* * * * *